US007367560B2

(12) United States Patent
Kawai

(10) Patent No.: US 7,367,560 B2
(45) Date of Patent: May 6, 2008

(54) SUCTION DEVICE AND METHOD OF CONVEYING LAMINATED SHEET

(75) Inventor: Tomohisa Kawai, Kanuma (JP)

(73) Assignees: Sony Corporation, Tokyo (JP); Sony Chemical & Information Device Corporation, Tokyo (JP)

( * ) Notice: Subject to any disclaimer, the term of this patent is extended or adjusted under 35 U.S.C. 154(b) by 0 days.

(21) Appl. No.: 11/523,592

(22) Filed: Sep. 20, 2006

(65) Prior Publication Data

US 2007/0013122 A1 Jan. 18, 2007

Related U.S. Application Data

(63) Continuation of application No. PCT/JP2005/005865, filed on Mar. 29, 2005.

(30) Foreign Application Priority Data

Apr. 1, 2004 (JP) ..... 2004-108794

(51) Int. Cl.
*B65H 5/04* (2006.01)

(52) U.S. Cl. ..... 271/276; 101/229

(58) Field of Classification Search ..... 271/276; 101/229, 230, 231
See application file for complete search history.

(56) References Cited

U.S. PATENT DOCUMENTS 4,127,265 A * 11/1978 Wirz et al. ..... 271/260
4,930,414 A * 6/1990 Wirz ..... 101/183
5,127,329 A * 7/1992 DeMoore et al. ..... 101/420
5,456,178 A * 10/1995 Henn et al. ..... 101/407.1
5,626,075 A * 5/1997 Detmers et al. ..... 101/232
5,701,819 A * 12/1997 Stephan ..... 101/409
5,816,155 A * 10/1998 Stephan ..... 101/232
5,839,366 A * 11/1998 Schaede ..... 101/232
6,357,869 B1 * 3/2002 Rasmussen et al. ..... 347/102
6,435,088 B2 * 8/2002 Fujimoto ..... 101/232
6,457,409 B2 * 10/2002 Fujimoto ..... 101/232
6,477,951 B2 * 11/2002 Fujimoto ..... 101/232
6,585,263 B1 * 7/2003 Bredenberg et al. ..... 271/276
6,729,233 B2 * 5/2004 Knopp et al. ..... 101/232
6,899,327 B2 * 5/2005 Shimizu et al. ..... 271/276
2005/0012265 A1 * 1/2005 Berlingen et al. ..... 271/276

FOREIGN PATENT DOCUMENTS

EP 0 491 110 A1 6/1992
JP A-4-260553 9/1992

* cited by examiner

*Primary Examiner*—Patrick Mackey
*Assistant Examiner*—Gerald W McClain
(74) *Attorney, Agent, or Firm*—Oliff & Berridge, PLC

(57) ABSTRACT

A suction device of the present invention includes a suction roller and a vacuum chamber. The suction roller holds an adhesive sheet to its peripheral surface by suction while maintaining contact with the film surface of the adhesive sheet, and conveying the adhesive sheet by rotation. The vacuum chamber is constructed to hold the adhesive sheet on a concave support surface by suction. The vacuum chamber is disposed in the vicinity of the suction roller at an upstream position in the conveying route so as to form an S-shape in the conveying route with the outer peripheral surface of the suction roller.

2 Claims, 2 Drawing Sheets

PRIOR ART

SUCTION DEVICE AND METHOD OF CONVEYING LAMINATED SHEET

This is a continuation application of International Application No. PCT/JP2005/005865 filed Mar. 29, 2005. The entire disclosure of the prior application is hereby incorporated by reference herein its entirety.

RELATED TECHNICAL FIELDS

Related technical fields include suction devices capable of conveying a laminated sheet by contact with only one side surface, for example conveying an adhesive sheet to form an adhesive layer on film, and a method of conveying laminated sheets. Particularly, the present invention relates to the art of changing the tension occurring in the laminated sheet and changing the conveying direction of a conveyed sheet.

BACKGROUND

In general, when manufacturing a laminated sheet with an adhesive layer between a base film and a cover film, an adhesive sheet in which an adhesive layer is formed on a base film is exposed in an intermediate process.

In this intermediate process, the adhesive sheet cannot be interposed between a pair of conveying rollers. Therefore, such an adhesive sheet 2 is conveyed by using a suction roller 3 as shown in FIG. 3, so that the suction roller 3 is only in contact with the surface of the base film layer and not in contact with the surface of the adhesive layer.

The suction roller 3 in this case has a plurality of suction holes formed on the outer peripheral surface of a hollow cylindrical roller, for example. The adhesive sheet 2 is held by suction on the outer peripheral surface by vacuum suction inside the shaft through the suction holes. The suction roller 3 holds and conveys the adhesive sheet 2 with rotation of the roller. See "Product Information Ni Net Suction Roll", URL:http:www2s.biglobe.ne.jp/~hikoyama/sakushon.htm (last verified Jan. 26, 2004). The suction roller 3 has the function of releasing the tension occurring in the adhesive sheet 2 by applying suction to and holding the adhesive sheet 2.

SUMMARY

In the conventional method of conveying an adhesive sheet 2 by only the suction roller 3 as shown in FIG. 3, it is necessary to-hold the adhesive sheet 2 by suction to maintain a central angle (hereinafter "winding angle") of the adhesive sheet 2 when wound on the suction roller 3. For example, an adhesive sheet 2 with the adhesive layer on the top surface which is conveyed in the direction of the arrow A cannot be conveyed in the direction of the arrow d because this would cause the adhesive sheet 2 to bend in the direction of the adhesive layer side. In such a case, the adhesive sheet 2 can be conveyed only in the direction in the directions of the arrows a to c which causes the adhesive sheet 2 to bend towards the non-adhesive side.

That the adhesive sheet 2 can be conveyed only by bending the adhesive sheet 2 to the non-adhesive side (film side) not only limits the conveying route or passage itself, but also limits disposition of equipment on the conveying passage, and further causes the problem that such a conveying passage cannot be introduced into existing facilities.

For example, to be able to introduce the adhesive sheet 2 into an existing dryer chamber or oven chamber, the position of the existing suction roller 3 must be changed or an additional suction roller 3 has to be added in order to increase the winding angle of the adhesive sheet 2 so that the tension of the adhesive sheet 2 can be released. If the position of the suction roller 3 is changed, the transfer passage changes, and as a result, the adhesive sheet 2 cannot be introduced into an existing drier chamber or the like such that the tension has been released in the adhesive sheet 2.

When the angle of the conveying route is small, the winding angle of the adhesive sheet 2 is also small, resulting in the net suction force applied to the adhesive sheet 2 being decreased. Therefore it causes the problem that the tension of the adhesive sheet 2 upstream is not sufficiently released, and thereafter the suction sheet 2 slips on the suction roller 3.

Accordingly, it is beneficial to provide a suction device which is capable of changing the conveying passage or route and is able to convey a laminated sheet without causing the laminated sheet to slip. This is accomplished by maintaining a sufficient suction force on the adhesive sheet irrespective of the direction taken by the conveying passage.

The present invention achieves the above described objectives by providing a suction device which holds and conveys a sheet-shaped member. The suction device includes a suction roller which holds and conveys a laminated sheet having a coating layer formed on the sheet while holding the sheet on an outer peripheral surface, and a vacuum chamber having a concave shaped suction part which holds the aforesaid laminated sheet while closely holding the sheet in a concave shape. The vacuum chamber is disposed so that the suction part is upstream in the conveying direction from the suction roller in order to form an S-shaped conveying passage with the outer peripheral surface of the suction roller. Furthermore, the present invention provides a method of conveying a laminated sheet having a coating layer formed on the sheet, including the steps of holding and conveying the laminated sheet in a concave shape, and thereafter, holding and conveying the laminated sheet in a convex shape.

According to the present invention, the conveying passage of a laminated sheet can be changed as needed. The invention includes an S-shaped conveying passage in cross-section formed by the combination of a suction roller for holding and conveying a laminated sheet and a vacuum chamber having a concave shaped suction part for holding a laminated sheet. Moreover, the present invention can convey a laminated sheet without the laminated sheet slipping irrespective of the direction of the conveying passage, because a sufficient suction force is provided by both the suction roller and the vacuum chamber.

DETAILED DESCRIPTION

Hereinafter, examples of the suction device will be described in detail.

Figure 1:
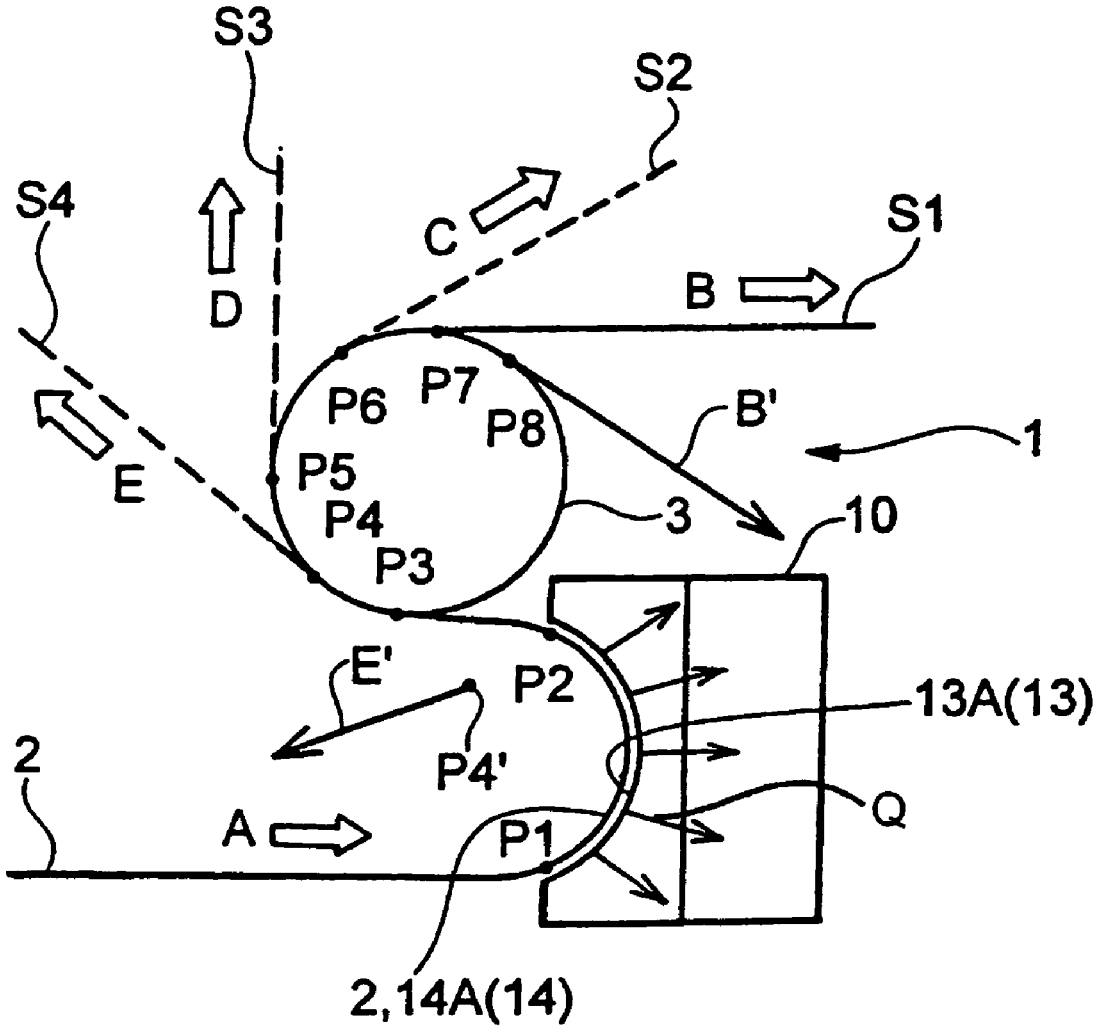
FIG. 1 is a front view showing an exemplary construction of a suction device.
Figure 2:
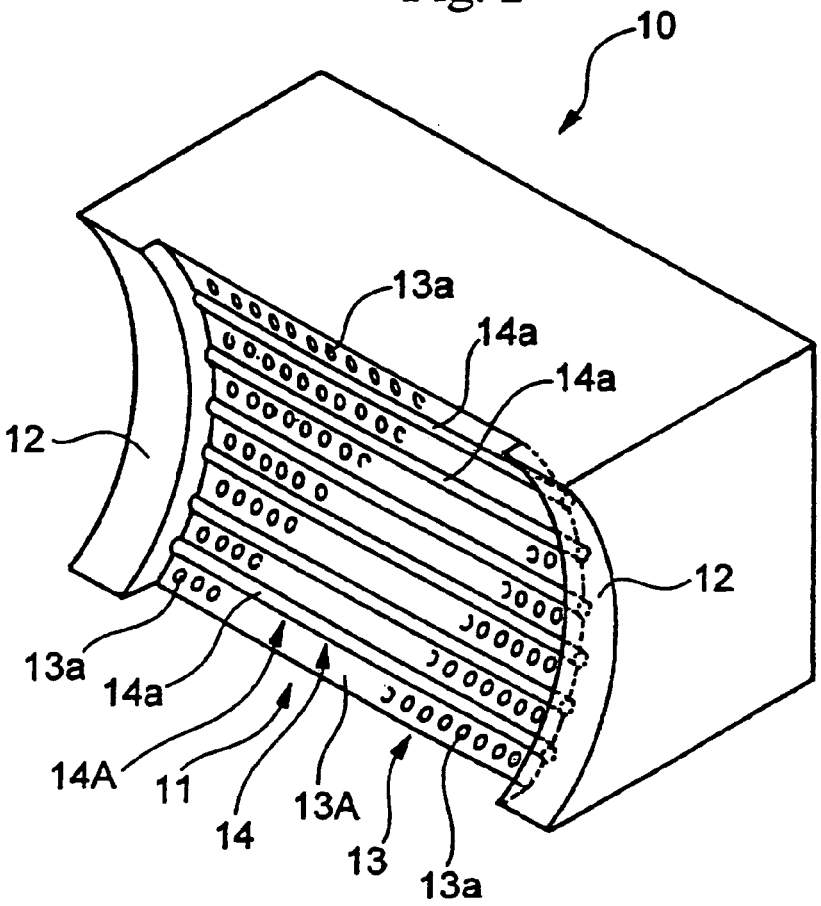
FIG. 2 is a perspective view showing an exemplary construction of a vacuum chamber.
Figure 3:
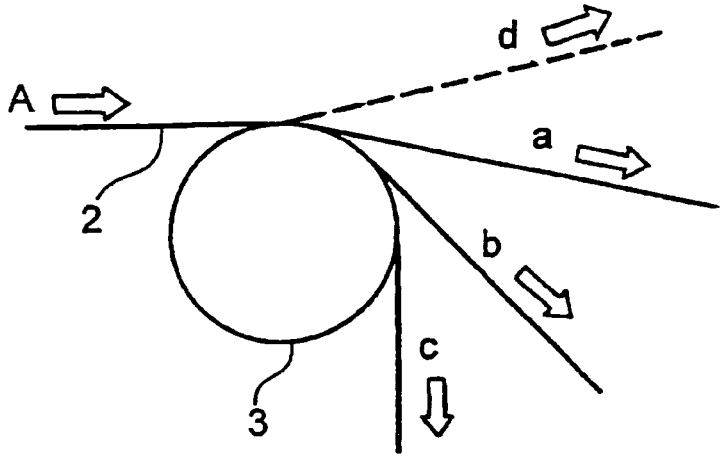
FIG. 3 is a view showing a conventional method for conveying an adhesive sheet using a suction roller.

As shown in FIGS. 1 and 2, a suction device 1 is installed at the spots where a conveying passage of an adhesive sheet 2 is changed, and/or where tension of the adhesive sheet 2 should be released, in an intermediate process step of conveying the adhesive sheet (laminated sheet) 2. The adhesive sheet 2 comprises an exposed adhesive layer (coating layer) formed on the surface of one side of a base film (sheet). This suction device comprises a suction roller 3 and a vacuum chamber 10, which are constructed as a set.

The suction roller 3 is a hollow cylindrical roller similar to ordinary rollers in which a plurality of suction holes is formed on the outer peripheral surface. The inside thereof is sufficiently hollow to enable a vacuum pump (not shown) to produce suction at the holes. Such a suction roller 3 holds the adhesive sheet 2 by suction through the suction holes formed on the outer peripheral surface of the suction roller 3 while contacting the surface of the non-adhesive side of the base film. The suction roller 3 holds the adhesive sheet 2 by suction and conveys it with rotation.

The vacuum chamber 10 is in a hollow box-shape which holds the adhesive sheet 2 by suction. The inside of the vacuum chamber 10 is constructed to allow evacuation by a vacuum pump (not shown). The section force of the vacuum chamber 10 with respect to the adhesive sheet 2 is set at a desired value by pressure adjustment of the vacuum pump. In one example, the suction force of the vacuum chamber 10 is set to be larger than the tension force occurring to the adhesive sheet 2 upstream in the conveying direction (hereinafter "upstream side"), and the suction force has the function of releasing the tension.

A suction support part (suction part) 11 has a concave surface (for example, a partial-circle shaped surface) at the front face portion of the vacuum chamber 10. Guide parts 12 having a concave surface extending beyond the surface of the suction support part 11 are formed at both sides of the suction support part 11. The suction support part 11 comprises a double curved surface structure, and includes a suction part 13 at the inside and a conveying and supporting part 14 on the outside.

In the suction part 13, a plurality of suction holes 13*a* are arranged in a predetermined pattern on the concave plate to form a concave suction surface 13A, so that the adhesive sheet 2 by means of the surface on the non-adhesive side of the base film, is uniformly held by suction through the suction holes 13*a* of the concave suction surface 13A.

In the conveying and supporting part 14, a plurality of rotary shafts (rotary bodies) 14*a* pivotally supported at both sides by the guide parts 12 are, for example, horizontally provided at specific intervals, resulting in a concave support surface 14A. By this surface arrangement, an adhesive sheet 2 is movably supported while held in a concave manner on the concave support surface 14A. In this example, the respective rotary shafts 14*a* are disposed so that the concave support surface 14A becomes coaxial with the concave suction surface 13A.

The vacuum chamber 10 is disposed in the vicinity upstream of the suction roller 3 so that the concave support surface 14A connects to the outer peripheral surface of the suction roller 3 to form a conveying route S-shaped in cross-section.

Suction device 1 holds the adhesive sheet 2 by a suction force shown by arrows Q in FIG. 1, holding an adhesive sheet 2 against the concave support surface 14A of the vacuum chamber 10. The suction roller 3 holds and conveys an adhesive sheet 2 by providing a suction force in the centripetal direction and by providing a conveying force in a tangential direction to the adhesive sheet 2 when it is on the outer peripheral surface of the suction roller 3, as shown in FIG. 1.

The radius of curvature of the concave support surface 14A of the vacuum chamber 10 can be chosen irrespective of the radius of the outer peripheral surface of the suction roller 3. In one example, the radius of curvature of the concave support surface 14A is about the same as the radius of the outer peripheral surface of the suction roller 3. The necessary central angle of the concave support surface 14A is relative to the relationship between the position of the suction roller 3 and the set pressure of the vacuum pump. It is large in the case of large suction forces on the adhesive sheet 2. The central angle is set at 180° in this example, whereby the conveying passage of the adhesive sheet 2 is inversed by 180°.

Next, as shown in FIG. 1, is the case where an adhesive sheet 2 with the adhesive layer on the top surface is conveyed from the upstream side (left side in FIG. 1) to the downstream side (right side in FIG. 1) with respect to the suction device 1. A method of conveying the laminated sheet of the present example is hereafter described.

In the conveying method of the adhesive sheet (laminated sheet) 2 of this example, the adhesive sheet 2 is held by suction and conveyed while the base film (sheet) is in close contact with the vacuum chamber 10 in a concave shape. This results in a reverse of the conveying direction. Thereafter, the adhesive sheet 2 is held and conveyed by the suction roller 3 while the base film is in close contact with the outer periphery of the suction roller 3 giving the adhesive sheet 2 a convex shape.

Here, the vacuum chamber 10 is disposed in the vicinity to the lower right of the suction roller 3 in FIG. 1, and the concave support surface 13A of the vacuum chamber 10 connects to the outer peripheral surface of the suction roller 3 via an inflection point tangential line such that the conveying passage forms an S-shape in cross-section.

Hereinafter, several kinds of conveying passages for the adhesive sheet 2 will be described.

When the adhesive sheet 2 is conveyed via a conveying passage S1 heading in the direction of the arrow A in FIG. 1 and thereafter in the direction of the arrow B which is parallel with the direction of the arrow A, the conveying passage S1 is divided into a plurality of conveying branch passages as it passes from a point P1 to point P7.

Here, the conveying branch passages P1 to P2 are conveying passages on the concave support surface 14A of the vacuum chamber 10. Here, the uniform suction force Q acts on the concave suction surface 13A by vacuum from the suction part 13. By this suction force Q, the adhesive sheet 2 is held against the entire surface of the concave support surface 14A to cause its film surface to be in close contact with the rotary shafts 14*a*. The adhesive sheet 2 is thus in the state in which it is tangentially movable on each of the rotary shafts 14*a*.

The conveyer passages P3 to P7 are the conveying passages on the outer peripheral surface of the suction roller 3. Here, uniform suction force acts through the outer peripheral surface of the suction roller 3 by suction in the inside of the shaft of the suction roller 3. By this suction force, the adhesive sheet 2 is held through the range of P3 to P7 of the outer peripheral surface, and its film surface is brought into close contact with the outer peripheral surface of the suction roller 3.

By rotation of the suction roller 3, the conveying force in the tangential direction acts on the adhesive sheet 2, and the adhesive sheet 2 is fed in the direction of the arrow B via point P7 while the adhesive sheet 2 is rotated with the suction roller 3 by the above-mentioned conveying force.

As mentioned above, the adhesive sheet 2 is laid on the two conveying passages each in the shape of the concave curved surface connected with the inflectional tangent while being held by the vacuum chamber 10 and the suction roller 3, and is held and conveyed by the suction roller 3. The tension occurring to the adhesive sheet 2 on the upstream side of the point P1 is released by the suction force through the concave support surface 14A, and the tension is newly set during the range from P3 to P7 on the outer peripheral surface of the suction roller 3 by various factors such as the suction force and rotational speed of the suction roller 3.

When the adhesive sheet 2 is conveyed via the conveying passage S2 heading first in the direction of the arrow A and thereafter in the direction of arrow C diagonally upward in FIG. 1, the conveying passage S2 passes from the point P1 to the point P6. The conveying passage S2 differs from the above described conveying passage S1 because the suction force and the conveying force do not act on the adhesive sheet 2 in the range from P6 to P7 on the outer peripheral surface of the suction roller 3.

Similarly to the above, when the adhesive sheet 2 is conveyed via the conveying passage S3 heading first in the direction of the arrow A and thereafter in the direction of the arrow D vertically upward, the conveying passage S3 passes from P1 to P5. When the adhesive sheet 2 is conveyed via a conveying passage S4 heading first in the direction of the arrow A and thereafter in the direction of the arrow E diagonally upward, the conveying passage S4 passes from P1 to P4.

As described above, the range of the conveying direction with respect to the adhesive sheet 2 conveyed from direction A is changeable between the direction of arrow B and the direction of arrow E. In order to enlarge this range, it is necessary to increase the winding angle of the adhesive sheet 2 with respect to the suction roller 3 and to pull the adhesive sheet 2 in the direction of the arrow B' diagonally downward from the direction of arrow B.

To make the central angle of the concave support surface 14A larger than 180°, the suction roller 3 is moved diagonally downward, whereby the point P4 moves to the point P4' which is diagonally downward from the point P4, and the conveying passage moves from the direction of arrow E to the direction of E' which is diagonally downward from the direction of arrow E.

In this case, the insufficient amount of suction force and conveying force caused by the decrease in the winding angle of the adhesive sheet 2 must be compensated by the suction force of the vacuum chamber 10 by an increase in the diameter of the suction roller 3 and by an increase in pressure of the vacuum pump.

If a plurality of suction devices 1 are properly disposed at a point where the conveying direction changes or where the tension in the adhesive sheet 2 should be released, the conveying direction of the adhesive sheet 2 conveyed from an unprescribed direction is unconstrained. is A decrease in the winding angle of the adhesive sheet 2 can be eliminated by disposing the plurality of suction devices 1.

According to the above described example, when the adhesive sheet 2 having an exposed adhesive layer is held and conveyed, the conveying passage of adhesive sheet 2 can be changed as desired by increasing or decreasing the winding angle of adhesive sheet 2 on the suction roller 3 which is positioned downstream in the conveying path. This follows because the S-shaped conveying passage is formed from the combination of the suction roller 3 for holding and conveying and the vacuum chamber 10 having a concave support surface 14A for vacuum holding.

Moreover, according to this example, a sufficient suction force can be secured with both the suction roller 3 and the vacuum chamber 10 irrespective of the direction of the conveying passage, and therefore, the adhesive sheet 2 can be conveyed without slippage.

According to this example, the concave support surface 14A formed by the arrangement of the rotary shafts 14*a* is located at the outside of the concave suction surface 13A of the suction part 13. Therefore, the rotational driving force of the suction roller 3 can be reduced by decreasing the contact resistance of the adhesive sheet 2.

Further, according to this example, the suction force of the vacuum chamber 10 is set to be larger than the upstream tension occurring in the adhesive sheet 2 because the tension can be released only by the vacuum chamber 10. Thereafter the tension in the adhesive sheet 2 can be varied by changing the setting of various factors relating to the suction roller 3.

The present invention is not limited to the above described examples, and various changes and the like can be made while staying within the scope of the invention.

In the above examples, it is preferable to provide the rotary body which supports the laminated sheet in a curved shape at the suction part in order to reduce the contact resistance of the laminated sheet. The rotary body is not limited to the rotary shaft of the above described examples, but may be a plurality of rotary rollers supported on a shaft such as beads on an abacus. In order to increase the suction force on the laminated sheet, the adhesive sheet may be curved in a concave manner and directly brought into close contact with the suction part.

Laminated sheets to which the present invention can be applied may be any sheet as long as it can be held by only one side surface, and such laminated sheets include not only adhesive sheets in which an adhesive layer is formed on a base film but also magnetic film with a magnetic layer (coating layer) formed on the film.

The above examples can be utilized in a device which manufactures adhesive sheets, and laminated sheets such as magnetic film.

What is claimed is:

1. A conveying method for a laminated sheet comprising a coating layer formed on a base film, comprising the steps of:

holding the laminated sheet by suction of a vacuum chamber and conveying the laminated sheet while maintaining contact with the other side of the base film of the laminated sheet, and maintaining the laminated sheet in a concave shape, and thereafter, holding the laminated sheet by suction of a suction roller and conveying the laminated sheet while maintaining contact with the other side of the base film of the laminated sheet on the suction roller at a predetermined angle, and maintaining the laminated sheet in a convex shape, wherein the suction force of the vacuum chamber to the laminated sheet is sufficient to overcome the tension in the laminated sheet upstream of the vacuum chamber, and increasing or decreasing the winding angle of the laminated sheet on the suction roller is performed in order to change the conveying passage of the laminated sheet to a downstream direction from the suction roller.

2. The conveying method according to claim 1, wherein the laminated sheet comprises an adhesive layer formed on one side of the base film.

* * * * *